US005175437A

United States Patent [19]

Waluszko

[11] Patent Number: 5,175,437

[45] Date of Patent: Dec. 29, 1992

[54] ULTRAVIOLET LIGHT APPARATUS

[76] Inventor: Alexander Waluszko, 1215 Valley View Ave., Pasadena, Calif. 91107

[21] Appl. No.: 806,716

[22] Filed: Dec. 12, 1991

[51] Int. Cl.[5] ..... H05B 35/00

[52] U.S. Cl. ..... 250/504 R; 250/494.1; 250/492.1

[58] Field of Search ..... 250/504 R, 494.1, 493.1, 250/492.1, 455.1, 454.1; 34/4

[56] References Cited

U.S. PATENT DOCUMENTS 4,220,865 9/1980 Siberman ..... 250/504 R 4,967,090 10/1990 Schlitt ..... 250/504 R

*Primary Examiner*—Jack I. Berman

*Attorney, Agent, or Firm*—J. E. Brunton

[57] ABSTRACT

A compact, easy to use apparatus for irradiating an object such as a specimen of material with ultraviolet radiation at a selected long, short or mid-wave length. The apparatus of the invention includes a plurality of ultraviolet sources, each emitting radiation at a different wave length. The sources are mounted within a rotatable array so that a selected one of the sources can be sequentially moved into alignment with the specimen and then automatically energized by merely rotating the array.

19 Claims, 5 Drawing Sheets

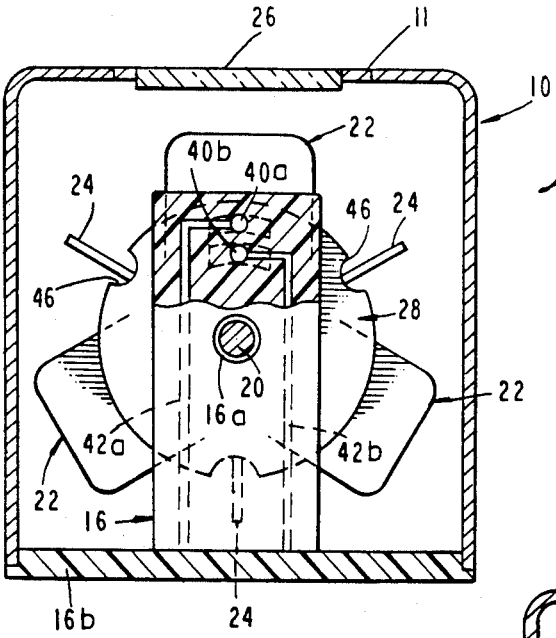
FIG. 3
FIG. 5
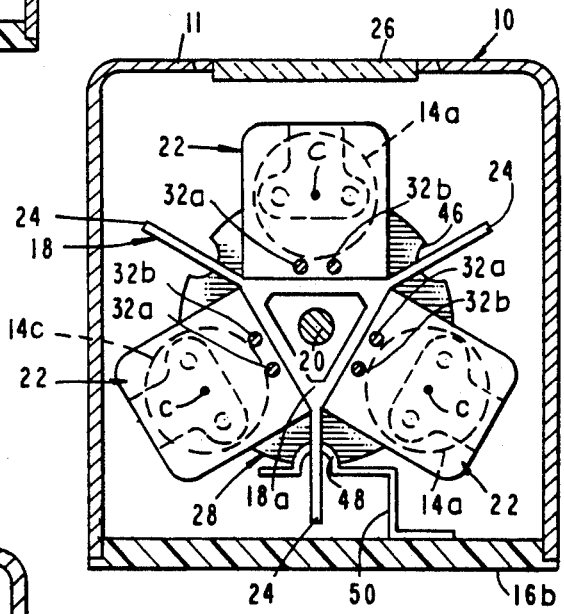
FIG. 4
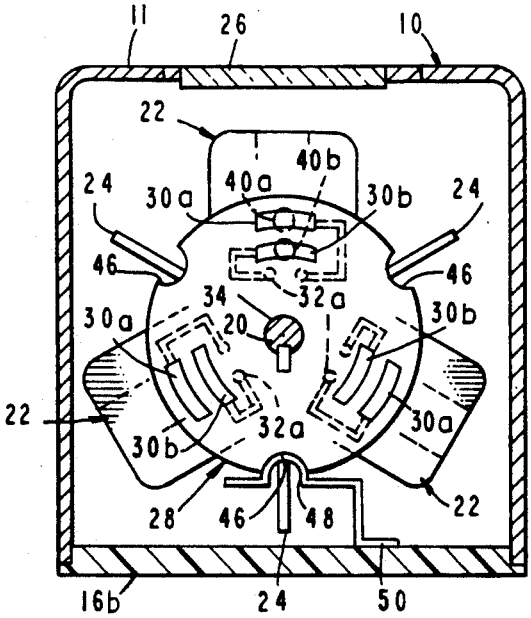
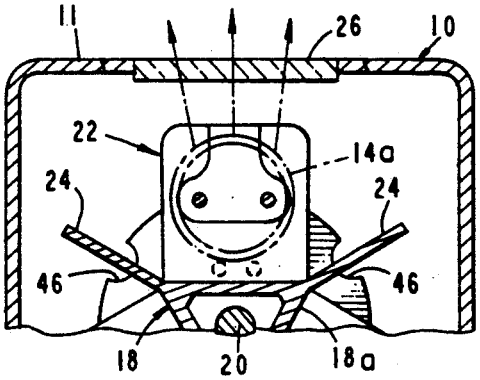
FIG. 6

ULTRAVIOLET LIGHT APPARATUS

BACKGROUND OF THE INVENTION

1. Field of the Invention

The present invention relates generally to ultraviolet lighting devices. More particularly, the invention concerns an ultraviolet fixture that uniquely provides for three separate ultraviolet wave lengths within one lamp enclosure.

2. Discussion of the Invention

Ultraviolet lighting devices are commonly used in scientific, medical industrial, and educational applications to elicit a reaction from a specimen exposed to the ultraviolet radiation (UV). Ultraviolet light is electromagnetic radiation in the region of the spectrum located between X-rays and visible light. It is divided into three principal ranges: 1) UV-A, or long wave, 2) UV-B, or mid-range, and 3) UV-C, or short wave. For each of these UV ranges specific applications have been developed, and new applications are continuously being developed.

To obtain a desired ultraviolet wave length, the fluorescent style tube is most commonly used. The fluorescent tube is an electric discharge device that uses a low pressure mercury vapor arc to generate ultraviolet energy. The ultraviolet energy released in typical, commercially available fluorescent tubes is primarily at the wave length of about 254 nanometers. In general, this ultraviolet energy is converted into other ultraviolet wave lengths by the use of phosphors which have the ability to absorb the ultraviolet energy and re-radiate it in other wave lengths. For example, long wave ultraviolet of about 365 nanometers and mid-range ultraviolet of about 300 nanometers are created by coating the inside of the fluorescent tubes with the proper phosphor(s) which convert the short wave ultraviolet. The envelope of the tube is also typically made of a glass that inhibits the passage of the short wave ultraviolet. To obtain a short wave ultraviolet tube, a special glass that transmits about 254 nanometers is generally used, and no phosphor is required.

In the past ultraviolet irradiation of selected specimens has been accomplished using a single UV range fluorescent tube mounted in either a metal or plastic enclosure. To eliminate extraneous ambient white light generated by the UV tube, a UV transmitting filter/ambient light blocking filter, is typically mounted in front of the UV tube. When it was desired to obtain two UV ranges (wave lengths) from a single enclosure, two UV tubes emitting two levels of UV radiation were generally mounted side by side within the enclosure, and an appropriate filter was placed in front of each tube.

When it was necessary to illuminate a large area with a UV range (wavelength), several fluorescent tubes of the same UV range were typically placed side by side within a large fixture having the proper electrical ballast to power the tubes. In these instances, a large piece of UV transmitting/ambient white light blocking filter was typically placed in an opening through which the UV light was transmitted.

Because of the side by side mounting of the fluorescent tubes in the prior art, UV irradiation devices, the devices were unnecessarily large, bulky, and difficult to transport and store. Further, when the specimen was to be irradiated by several different ranges of UV radiation, either separate fixtures had to be used or fixtures having complex filtering, switching and power supply requirements were needed.

Exemplary of prior art devices of which Applicant is aware that may have some pertinence to the present disclosure, are those disclosed in U.S. Pat. No. 4,015,353, issued to Zarfat, and U.S. Pat. No. 4,002,022, issued to Lopez. The Zarfat patent relates to an advertising display device while the Lopez patent refers to a rotating electro-mechanical sign.

SUMMARY OF THE INVENTION

It is an object of the present invention to provide an apparatus for expeditiously irradiating an object, such as a specimen of material, with ultraviolet radiation at a selected long, short or mid-wave length.

More particularly, the apparatus of the invention comprises a plurality of ultraviolet sources, each emitting radiation at a different wave length, which are mounted within a rotatable array so that a selected one of the sources can be moved into alignment with the specimen and automatically energized by merely rotating the array.

Another object of the invention is to provide an apparatus of the aforementioned character in which the sources of ultraviolet radiation comprise fluorescent tubes, each emitting ultraviolet radiation at a selected wave length.

Another object of the invention is to provide an apparatus as described in the preceding paragraphs in which the specimen can be irradiated with ultraviolet radiation at a selected wave length between about 254 nanometers and about 365 nanometers.

Still another object of the invention is to provide an apparatus of the class described which includes strategically located reflectors for reflecting the ultraviolet radiation in a direction toward the specimen.

Another object of the invention is to provide an apparatus as described in the preceding paragraphs in which a filter for blocking interfering light from the sources can be interposed between the specimen and the energized source.

Yet another object of the invention is to provide an apparatus of the character described which is compact, light weight, inexpensive and easy to use.

BRIEF DESCRIPTION OF THE DRAWINGS

FIG. 3 is a cross-sectional view taken along lines 3—3 of FIG. 2.

FIG. 4 is a cross-sectional view taken along lines 4—4 of FIG. 2;

FIG. 5 is a cross-sectional view taken along lines 5—5 of FIG. 2;

FIG. 6 is a cross-sectional view taken along lines 6—6 of FIG. 2;

DESCRIPTION OF THE INVENTION

Figure 1:
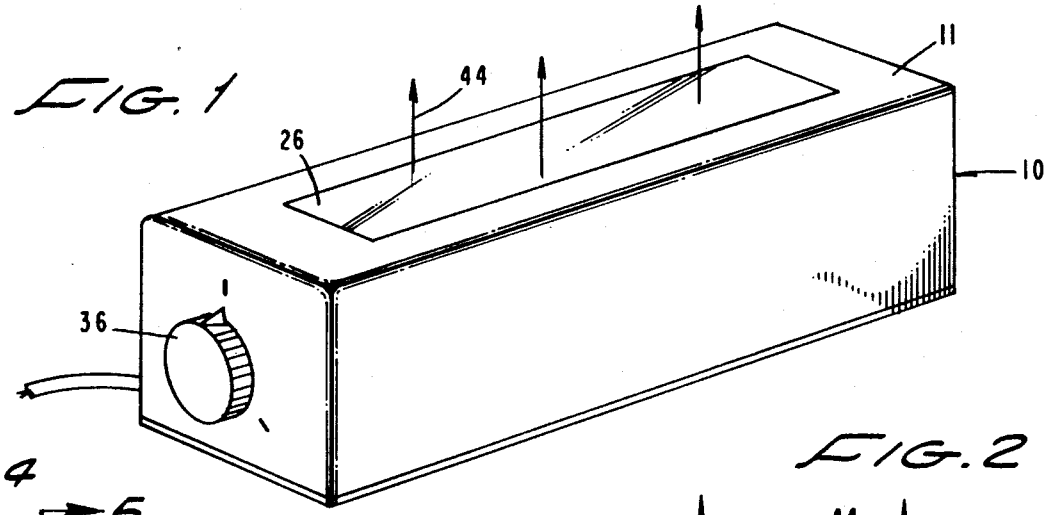
FIG. 1 is a generally perspective view of one form of the apparatus of the present invention.

Referring to the drawings and particularly to FIGS. 1 through 7, the apparatus of the present invention for irradiating an object with ultraviolet radiation comprises a fixture or housing 10 within which an array 12 of a plurality of sources of ultraviolet radiation is rotatably mounted. In the embodiment of the invention shown in these Figures, the sources comprise three fluorescent tubes, 14*a*, 14*b* and 14*c*, (FIGS. 5 and 10) each of which emits radiation at a particular wave length. The general construction of array 12 is best seen by referring to FIG. 7.

Referring particularly to FIG. 1, it can be seen that means are provided for rotating array 12 within fixture 10 in a manner so that only a selected one of the radiation sources is energized to emit radiation in the direction of the arrows of FIG. 1. In the present embodiment of the invention, this support means comprises a support assembly 16 which rotatably supports array 12 in a manner presently to be described.

Figure 7:
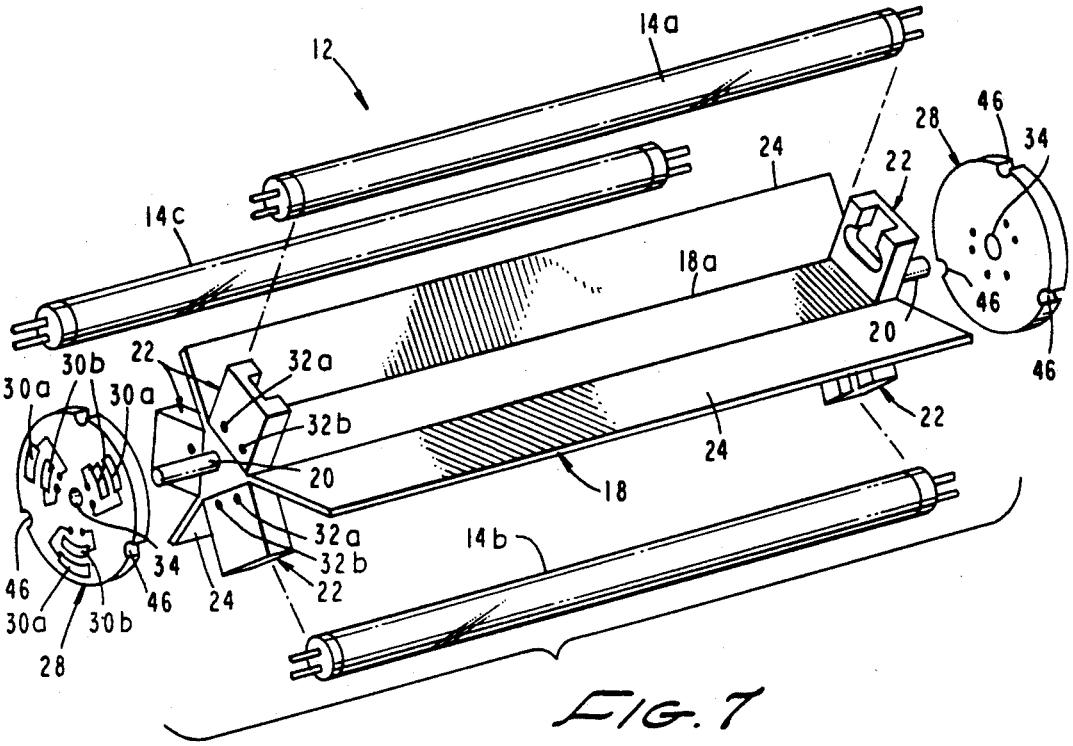
FIG. 7 is a generally perspective view of one form of the tube holding array of the apparatus of the present invention.
Figure 8:
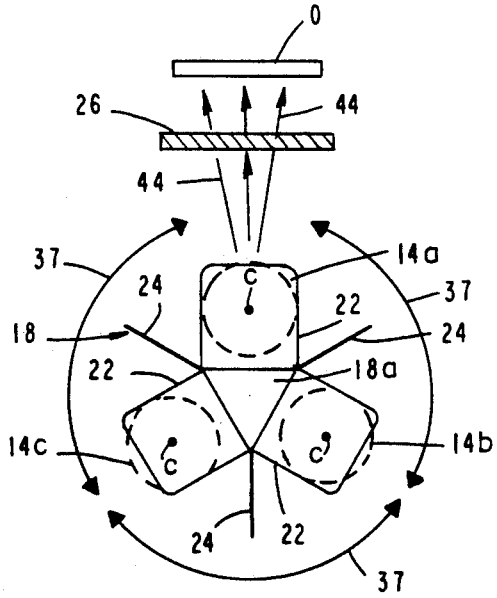
FIG. 8 is a cross-sectional diagrammatic view of the form of the array shown in FIG. 8.

Also forming a part of array 12, is a longitudinally extending reflector assembly 18 having a centrally disposed, triangular shaped body portion 18*a*. (FIGS. 5 and 7) Protruding from each end of reflector assembly 18 is a cylindrical rod 20 which, as shown in FIG. 1, is journaled within bearings 16*a* provided in support 16 so that array 12 can be rotated about the longitudinal axis of rod 20 in the manner illustrated by the arrows in FIG. 8. Affixed proximate each end of central portion 18*a* of the reflector assembly are three commercially available bi-pin lamp holders 22 (FIG. 7). These lamp holders 22 are adapted to operably receive lamps or fluorescent tubes 14*a*, 14*b* and 14*c* each having a longitudinal axis terminating at a central end point. Tubes 14*a*, 14*b* and 14*c* are also commercially available and known to those skilled in the art as Dual Bi-Pin Pre-Heat Fluorescent Tubes. As best seen in FIGS. 5 and 8, tubes 14*a*, 14*b* and 14*c* are uniquely arranged in a triangular relationship so that a line drawn through their central end points C will define a equilateral triangle.

Forming a part of reflector assembly 18 are reflector means comprising three radially outwardly extending reflector wings 24 which, along with central portion 18*a* form a highly reflective mirrored surface for reflecting the ultraviolet radiation emitted from the backside of each fluorescent tube 14*a*, 14*b*, and 14*c*. This reflected "back side stray" UV radiation combines with the up side UV radiation to increase the overall intensity of the radiation being directed toward the specimen or object O (FIG. 8). As shown in FIG. 8, in certain applications a light blocking filter means 26 may be disposed between the energized fluorescent tube and the object 0 which is to be irradiated. The shortwave UV emitted from the energized tube passes through filter 26 and blocks the unnecessary and interfering light that is normally generated by commercially available ultraviolet generating tubes or lamps. Filter 26 which is mounted in the top wall 11 of fixture 10 and is commercially available and is sold by HOYA COMPANY or SCHOTT COMPANY. The filter is long life and does not solarize quickly when exposed to ultraviolet radiation.

Turning to FIGS. 1 and 7, a transfer wheel 28 is received over rod 20 at each end of array 12 in the manner indicated in FIG. 7. Each transfer wheel 28 is provided with three pair of electrical contacts 30*a* and 30*b* which are electrically interconnected with electrical contacts 32*a* and 32*b* provided on each of the three adjacent lamp holders 22. As best seen in FIG. 7, each transfer wheel 28 is provided with a central aperture 34 which is closely receivable over rod 20. After the transfer wheels 28 are mounted over rod 20 and each pair of contacts 30*a* and 30*b* is electrically interconnected with their respective contacts 32*a* and 32*b* provided on the adjacent lamp holders 22, transfer wheels 28 will rotate with the lamp holders and the lamps when a rotational force is exerted on rod 20.

Figure 2:
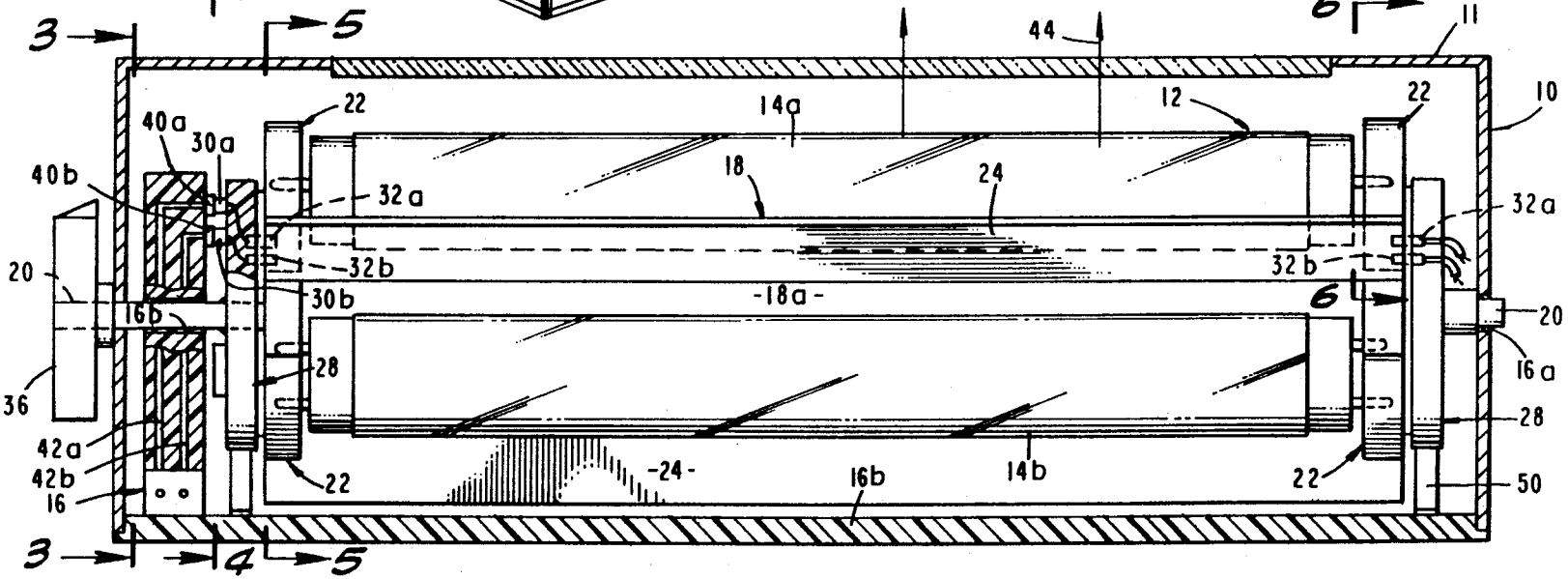
FIG. 2 is a cross-sectional side view of the apparatus shown in FIG. 1.

In the form of the invention shown in FIG. 2, a finger engaging wheel 36 is interconnected with one rod 20 in the manner shown. Finger engaging wheel 36 comprises a part of the previously identified means for rotatably moving the array in the directions indicated by the arrows 37 in FIG. 8. Provided on support 16 are electrical contacts 40*a* and 40*b* which are appropriately interconnected with a source of electrical power (not shown) by suitable connectors 42*a* and 42*b*. With this construction, as array 12 is rotated, a selected pair of contacts 30*a* and 30*b* provided on transfer wheels 28 can be moved into electrical contact with contacts 40*a* and 40*b*. When such contact is made, electrical contacts 32*a* and 32*b* on a selected one of the lamp holders 22 will be energized thereby energizing a selected one of the fluorescent tubes 14*a*, 14*b*, and 14*c*. For example, when the array is rotated to the position shown in FIG. 8, fluorescent tubes 14*a* is energized and will emit radiation toward object O through filter block 26 in the direction indicated by the arrows 44 in FIG. 8. Further clockwise rotation of the array will cause tube 14*c* to be energized so as to emit radiation toward the specimen.

It is to be understood that tube 14*a* may be selected so as to emit ultraviolet energy at a long wave length ultraviolet at approximately 365 nanometers (nm). In a similar fashion, fluorescent tube 14*b* may be selected to emit short-range ultraviolet radiation in the 250 nm wave length range and fluorescent tube 14*c* may be selected to emit mid-range ultraviolet radiation of a wave length on the order of 300 nm. By merely rotating array 12 using finger wheel 36, a selected one of the tubes 14*a*, 14*b*, and 14*c* may be moved into a position in alignment with filter block 26 and object O so that the object may be irradiated with the ultraviolet wave length of that particular fluorescent tube. The highly polished reflectors 24 function to focus the radiation emitted by the selected tube in the direction of the specimen so as to efficiently irradiate the specimen or object O with the ultraviolet radiation at the selected wave length.

Figure 9:
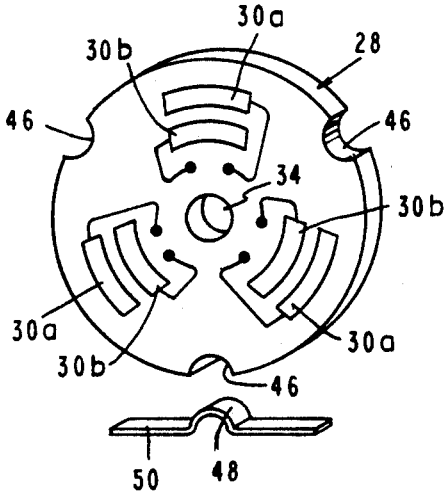
FIG. 9 is a generally perspective view of one form of the electrical contact transfer wheels of the apparatus of the invention.

Referring to FIGS. 4 and 9, it is to be noted that each of the transfer wheels 28 is provided with a strategically located lock-point notch 46. Notches 46 are constructed so as to closely receive a protuberance 48 formed on a locking element 50 which is connected to the base 16*a* of support assembly 16 of the apparatus of the invention. Locking element 50, which forms a part of the locking means of the invention, is strategically located so that when one of the notches 46 of the transfer wheel is in locking engagement with protuberance 48, a selected set of electrical contacts 30*a* and 30*b* will be perfectly aligned with contacts 40*a* and 40*b* provided on support assembly 16. This locking means permits the array to be rotated to a selected position wherein a selected one of the lamps 14*a*, 14*b*, and 14*c* is located in alignment with object O and is automatically energized due to the electrical interconnection of a selected pair of contacts 30*a* and 30*b* of the transfer wheel with contacts 40*a* and 40*b* of the support means.

Figure 10:
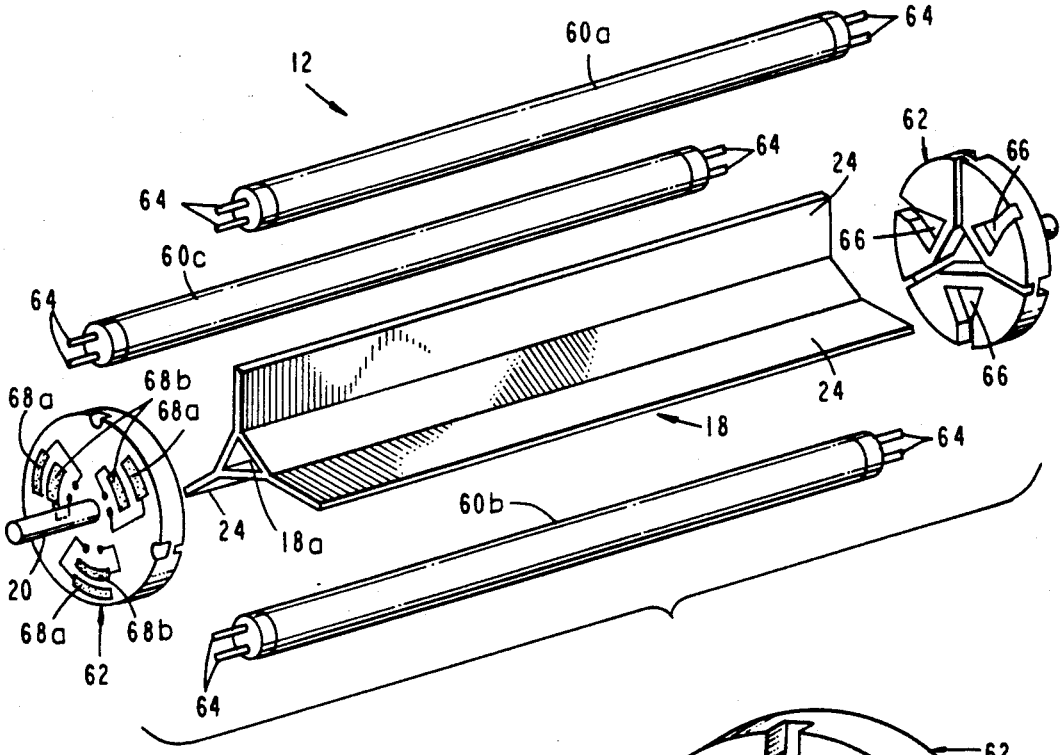
FIG. 10 is a generally perspective view of an alternate form of the tube holding array of the apparatus of the present invention which embodies specially designed, three tube bipin holders or end plates.
Figure 11B:
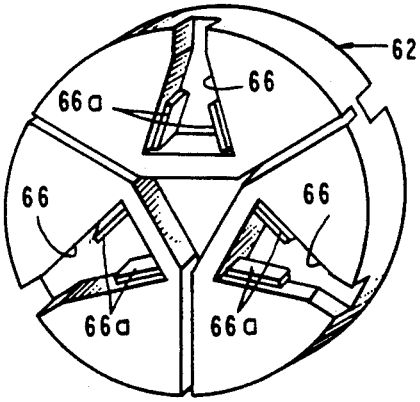
FIG. 11B is a generally perspective view of the inner face of one of the specially designed three tube bipin holders of the apparatus shown in FIG. 10.
Figure 11A:
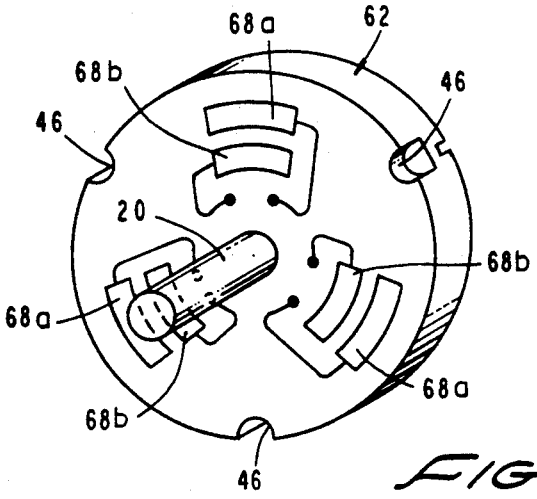
FIG. 11A is a generally perspective view of the outer face of one of the specially designed three tube bipin holders of the apparatus shown in FIG. 10.

Turning now to FIGS. 10, 11A and 11B another form of the apparatus of the invention is there illustrated. This apparatus is similar in most respects to the embodiment just described and like numerals are used to identify like components. The array 12, which is rotatably supported by a support assembly 16 of the character shown in FIG. 1, also comprises a reflector assembly 18 of the character previously described. However, the three fluorescent tubes 60*a*, 60*b*, and 60*c* and the transfer wheels 62 are of slightly different construction. In this later embodiment of the invention, tubes 60*a*, 60*b* and 60*c* are provided with specially designed electrical contact means shown here as contact pins 64 which are directly receivable within specially designed pin receptacles 66 provided on the inner faces of wheels 62 (FIG. 11B). The contacts 66*a* of receptacles 66 are directly wired to contacts 68*a* and 68*b* provided on the outer faces of wheels 62 (FIG. 11A). Contacts 68*a* and 68*b* mate with contacts 40*a* and 40*b* which are carried by support assembly 16. In the manner previously described, as the array 12 is rotated, a selected pair of contacts 68*a* and 68*b* will be moved into contact with contacts 40*a* and 40*b* thereby energizing the selected tube. With this construction, wheels 62 are connected to the reflector assembly 18 and lamp holders 22 are eliminated.

Figure 12:
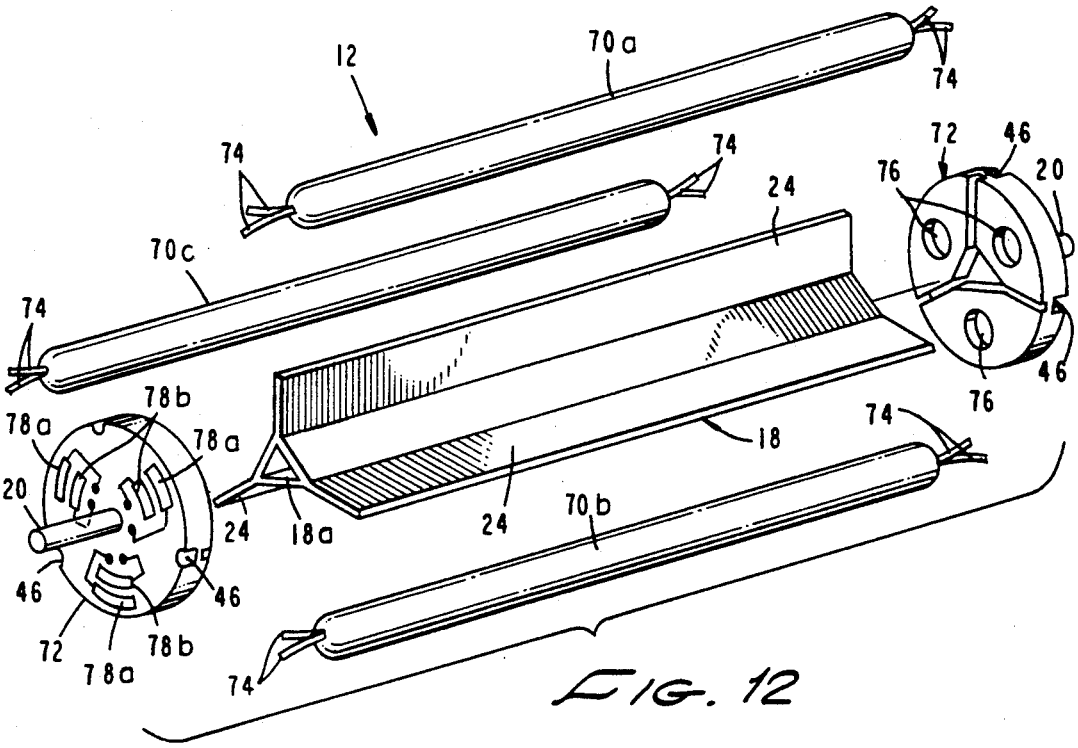
FIG. 12 is a generally perspective view of still another form of the tube holding sub-assembly of the apparatus of the present invention which embodies another form of specially designed three tube end caps.
Figure 12B:
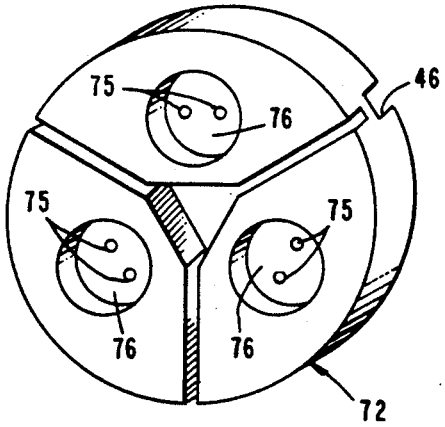
FIG. 12B is a generally perspective view of the inner face of one of the end caps of FIG. 12.
Figure 12A:
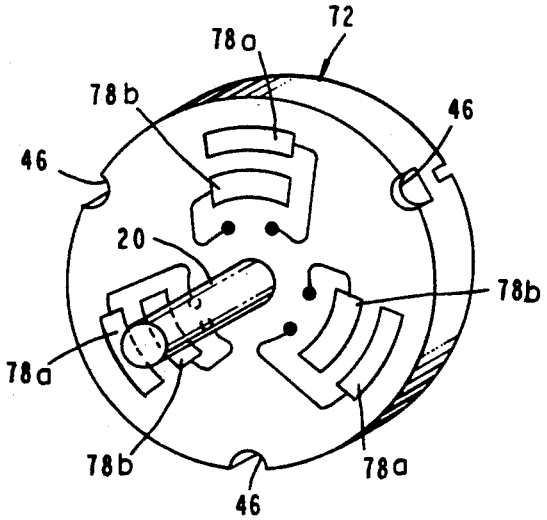
FIG. 12A is a generally perspective view of the outer face of one of the end caps of FIG. 12.

Referring to FIGS. 12, 12A and 12B, still another embodiment of the invention is there shown. This apparatus is also similar in most respects to the embodiments just described and like numerals are used to identify like components. The array 12, which is rotatably supported by a support assembly 16 of the character shown in FIG. 1, also comprises a reflector assembly 18 of the character previously described. However, the three fluorescent tubes 70*a*, 70*b*, and 70*c* and the transfer wheels 72 are of yet another construction. In the embodiment of the invention shown in FIG. 12, tubes 70*a*, 70*b*, and 70*c* are provided with bare contact wires 74 which are receivable within apertures 75 of specially designed sockets 76 provided on the inner faces of wheels 72 (FIG. 12B). The wires 74 are directly wired to contacts 78*a* and 78*b* provided on the outer faces of wheels 72 (FIG. 12A). Contacts 78*a* and 78*b* mate with contacts 40*a* and 40*b* which are carried by support assembly 16. In the manner previously described, as the array is rotated, a selected pair of contacts 78*a* and 78*b* will be moved into contact with contacts 40*a* and 40*b* thereby energizing the selected tube. With this construction, wheels 72 are connected directly to reflector assembly 18 and lamp holders 22 are eliminated.

Having now described the invention in detail in accordance with the requirements of the patent statutes, those skilled in the art will have no difficulty in making changes and modifications in the individual parts or their relative assembly in order to meet specific requirements or conditions. Such changes and modifications may be made without departure from the scope and spirit of the invention, as set forth in the following claims.

I claim

1. An apparatus for irradiating an object with ultraviolet radiation comprising:

(a) an array of sources of ultraviolet radiation, each source being capable of emitting ultraviolet radiation at a particular wave length; and (b) means for moving said array so that only a selected one of said sources emits radiation in the direction of the object.

2. An apparatus as defined in claim 1 in which said sources emit radiation at wave lengths between 254 nanometers and 365 nanometers.

3. An apparatus as defined in claim 1 in which said sources comprise fluorescent tubes each having a longitudinal axis terminating in an end point.

4. An apparatus as defined in claim 3 in which said sources comprise three fluorescent tubes arranged so that a line connecting said end point of said tubes defines a triangle.

5. An apparatus as defined in claim 3 in which said line connecting said end points defines an equilateral triangle.

6. An apparatus for emitting ultraviolet radiation comprising:

(a) a support;

rotatably mounted on said support and including at least two sources of ultraviolet radiation, each said source being capable of emitting ultraviolet radiation at a particular wave length; and (c) means for controllably rotating said array so that a selected one of said sources emits radiation in a first direction.

7. An apparatus as defined in claim 6 in which said sources comprise fluorescent tubes each having a longitudinal axis terminating at a central end point.

8. An apparatus as defined in claim 7 in which one of said sources emits long wave length ultraviolet radiation and the other of said sources emits short wave length ultraviolet radiation.

9. An apparatus as defined in claim 7 comprising three fluorescent tubes arranged so that a line connecting said end points of said tubes defines a triangle.

10. An apparatus as defined in claim 9 in which said support comprises a pair of spaced-apart ends, said array being rotatably supported between said ends.

11. An apparatus as defined in claim 9 in which said array further includes reflector means for reflecting radiation from each of said sources in said first direction.

12. An apparatus as defined in claim 9 in which one of said sources emits ultraviolet radiation at a wave length of approximately 250 nanometers, in which another of said sources emits ultraviolet radiation at a wave length of approximately 300 nanometers and a third of said sources emits ultraviolet radiation at a wave length approximately 365 nanometers.

13. An apparatus as defined in claim 9 in which said array includes;

(a) three fluorescent tubes each having electrical contact pins for energizing said lamp; and (b) transfer wheels connected to said reflector means, said transfer wheels having electrical contacts engageable by said electrical contact pins of said fluorescent tubes.

14. An apparatus as defined in claim 13 in which said support includes electrical contacts engageable by said electrical contacts of said transfer wheels.

15. An apparatus for irradiating an object with ultraviolet radiation comprising:

(a) an array of sources of ultraviolet radiation comprising three fluorescent tubes, each said tube emitting ultraviolet radiation at a different wave length; and (b) support means for rotatably supporting said array that each said tube is sequentially movable into a position whereby ultraviolet radiation from said tube is directed toward the object.

16. An apparatus as defined in claim 15 in which each said tube has a longitudinal axis terminating in an end point, said tubes being arranged so that a line interconnecting said end points defines a triangle.

17. An apparatus as defined in claim 16 in which one of said tubes emits radiation at a wave length of approximately 254 nanometers, another of said tubes emits radiation at a wave length of approximately 300 nanometers and a third said tube emits radiation at a wave length of approximately 365 nanometers.

18. An apparatus as defined in claim 17 in which said array includes filter means for filtering interfering light said filter means being interposed between said object and a selected one of said tubes.

19. An apparatus as defined in claim 18 in which said array includes reflector means for reflecting radiation from said tubes.

* * * * *